US010400425B2

(12) United States Patent
Horstman et al.

(10) Patent No.: US 10,400,425 B2
(45) Date of Patent: Sep. 3, 2019

(54) TRANSPORT CONTROL FOR WORK VEHICLES

(71) Applicant: Deere & Company, Moline, IL (US)

(72) Inventors: Nathan J. Horstman, Durango, IA (US); David A. Veasy, Dubuque, IA (US); Daniel D. Watson, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 296 days.

(21) Appl. No.: 15/292,879

(22) Filed: Oct. 13, 2016

(65) Prior Publication Data

US 2018/0106014 A1 Apr. 19, 2018

(51) Int. Cl.
*E02F 9/20* (2006.01)

(52) U.S. Cl.
CPC ..... *E02F 9/2012* (2013.01); *E02F 9/2037* (2013.01)

(58) Field of Classification Search
CPC ..... E02F 9/2033; E02F 3/844; E02F 3/845–3/848; E02F 3/7604; E02F 3/961; E02F 3/16; E02F 3/84; E02F 3/841; E02F 3/842; E02F 9/2025; E02F 9/2037; E02F 9/2041
See application file for complete search history.

(56) References Cited

U.S. PATENT DOCUMENTS

| | | | | |
|---|---|---|---|---|
| 6,129,156 | A * | 10/2000 | Boast | E02F 3/764 172/2 |
| 6,189,465 | B1 * | 2/2001 | Burns | A01B 63/32 111/33 |
| 6,220,366 | B1 * | 4/2001 | Noonan | A01B 73/046 172/311 |
| 8,401,743 | B2 | 3/2013 | Harber et al. | |
| 8,985,233 | B2 * | 3/2015 | Padilla | E02F 3/764 172/4.5 |
| 9,185,837 | B2 * | 11/2015 | Barnett | A01B 63/22 |
| 9,227,478 | B2 * | 1/2016 | Horstman | B60G 17/00 |
| 9,521,799 | B2 * | 12/2016 | Tuttle | A01B 63/22 |
| 9,540,787 | B2 * | 1/2017 | West | E02F 3/847 |
| 9,999,171 | B2 * | 6/2018 | Magarity | A01B 73/046 |
| 2011/0108294 | A1 * | 5/2011 | Thomson | E02F 3/764 172/1 |
| 2015/0025759 | A1 * | 1/2015 | Tuttle | A01B 63/22 701/50 |
| 2016/0024750 | A1 * | 1/2016 | Yoshimura | E02F 3/764 172/796 |
| 2016/0362858 | A1 * | 12/2016 | May | E01H 5/067 |

* cited by examiner

*Primary Examiner* — Matthew Troutman
(74) *Attorney, Agent, or Firm* — Klintworth & Rozenblat IP LLP

(57) ABSTRACT

A control system for a work vehicle has at least one controller and at least one operator control with one or more control inputs configured to send control signals to the controller. The controller is configured to output a plurality of control commands corresponding to one or more control signals from a single activation event of the one or more control inputs. The control commands are configured to effect movement of multiple work implements into stowed orientations.

18 Claims, 5 Drawing Sheets

TRANSPORT CONTROL FOR WORK VEHICLES

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to the control of work vehicle implements and non-work implement components when readying for transport of the work vehicle.

BACKGROUND OF THE DISCLOSURE

Off-road work vehicles of various types may have one or more implements for carrying out various work operations. Motor graders, for example, may have a main blade, sometimes referred to as a "moldboard," for performing ground clearing or smoothing operations. Such motor graders may also have other implements, such as a scarifiers, rippers or other blades, which may be used to perform other ground working operations (e.g., ground loosening or other ground clearing or smoothing operations) before, during or after the operation performed by the blade.

The work vehicles are typically transported via roadways to and from remote work sites, either by another transport vehicle or under the vehicle's power. In either case, when preparing the work vehicle for transport the work implements and other components of the work vehicle may need to be moved or alternated in some manner from their current position or state of operation. For example, the position of one or more of the work implements may need to be changed (e.g., to a stowed or raised position) or the state of various hydraulic and electric components may need to be changed (e.g., transport lights may need to be activated).

SUMMARY OF THE DISCLOSURE

This disclosure provides an operator control system for efficiently readying a work vehicle, such as a motor grader and the like, for transport.

In one aspect the disclosure provides a control system for a work vehicle having a plurality of movable components including at least two work implements. The control system includes at least one controller and at least one operator control having one or more control inputs configured to send control signals to the controller. The controller is configured to output a plurality of control commands corresponding to one or more control signals from a single activation event of the one or more control inputs. The control commands are configured to effect movement of the work implements into stowed orientations.

In another aspect the disclosure provides a control system for a work vehicle having a plurality of movable components including at least two work implements. The control system includes at least one operator control having one or more control inputs, and at least one controller configured to receive input indicative of a current posture of the work vehicle and determine whether the work implements may be stowed in the current posture of the work vehicle. Having determined that the work implements may be stowed in the current posture of the work vehicle, the controller is configured to output a plurality of control commands corresponding to one or more control signals from a single activation event of the one or more control inputs to effect movement of the work implements into stowed orientations.

Another aspect of the disclosure provides a work vehicle with a chassis supported by ground-engaging wheels or tracks, a plurality of movable components mounted to the chassis, including multiple work implements and multiple non-work implements, and a control system. The control system includes at least one operator control having one or more control inputs and at least one controller configured to output a plurality of control commands corresponding to one or more control signals from a single activation event of the control inputs. The control commands are configured to effect movement of at least one of the work implements into a stowed orientation and to change a state of at least one of the non-work implements.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
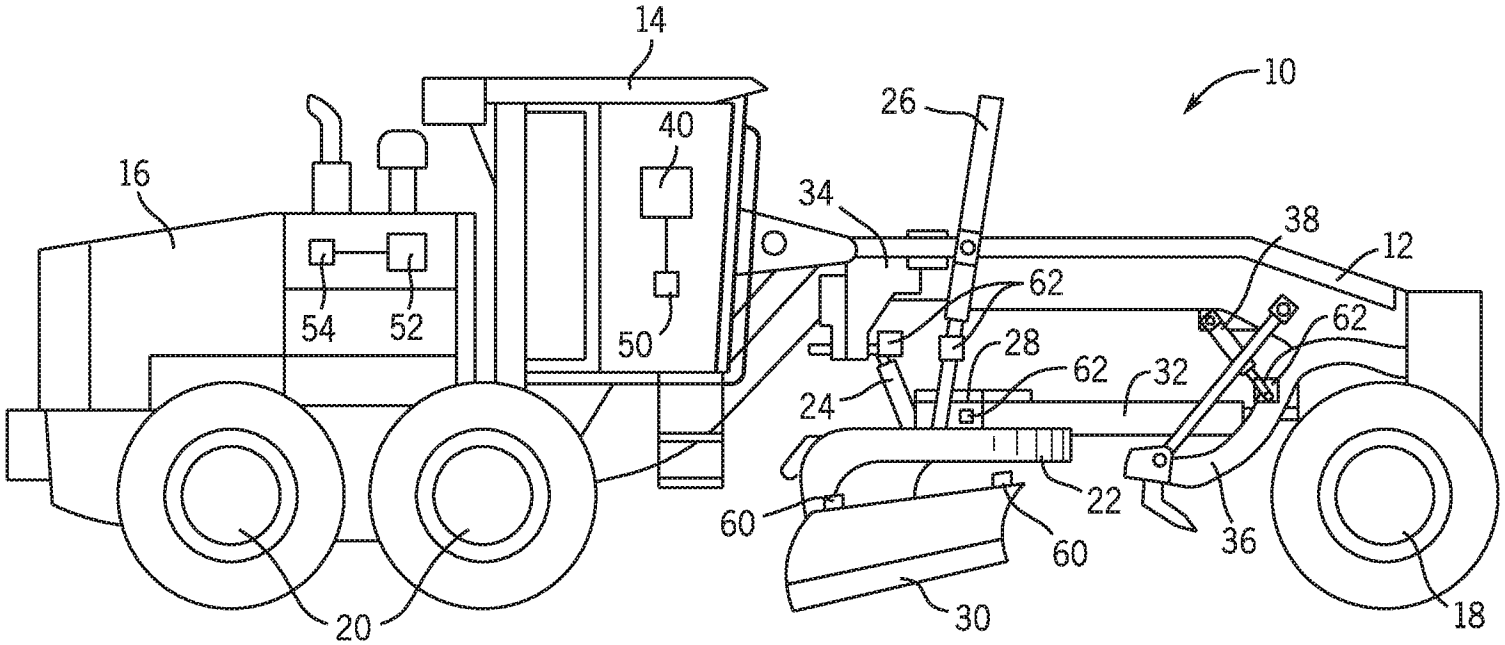
FIG. 1 is a side view of an example work vehicle in the form of a motor grader in which the disclosed transport control system may be used.

The following describes one or more example embodiments of the disclosed work vehicle control system, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Furthermore, in detailing the disclosure, terms of direction and orientation, such as "forward," "aft," "lateral," "horizontal," and "vertical" may be used. Such terms are defined, at least in part, with respect to the direction in which the work vehicle or implement travels during use. The term "forward" and the abbreviated term "fore" (and any derivatives and variations) refer to a direction corresponding to the direction of travel of the tillage implement, while the term "aft" (and derivatives and variations) refer to an opposing direction. The term "fore-aft axis" may also reference an axis extending in fore and aft directions. By comparison, the term "lateral axis" may refer to an axis that is perpendicular to the fore-aft axis and extends in a horizontal plane; that is, a plane containing both the fore-aft and lateral axes. The term "vertical," as appearing herein, refers to an axis or a direction orthogonal to the horizontal plane containing the fore-aft and lateral axes.

As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the motor grader described herein is merely one exemplary embodiment of the present disclosure.

Conventional techniques related to signal processing, data transmission, signaling, control, and other functional aspects of the systems (and the individual operating components of the systems) may not be described in detail herein for brevity. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

The following describes one or more example implementations of the disclosed control system for transporting of a work vehicle, as shown in the accompanying figures of the drawings described briefly above. Generally, the disclosed control system (and work vehicles in which they are implemented) allows for improved operator stowing of multiple implements and non-work implements of a work vehicle, as compared to conventional systems.

Generally, an implement may be movable with respect to a work vehicle (or other work machine) by various actuators in order to accomplish tasks with the implement. Discussion herein may sometimes focus on the example application of moving implements of a motor grader, with actuators for moving the implements generally configured as hydraulic cylinders. In other applications, other configurations are also possible. In some embodiments, for example, one or more of the implements may be a blade (e.g., a front blade or snow wing), a (mid- or rear-) scarifier, a ripper or other known implement. Likewise, work vehicles in some embodiments may be configured as tractors, loaders, dozers or similar machines.

Work vehicles used in various industries, such as the agriculture, construction and forestry industries, may include tools, implements or other sub-systems used to carry out various functions for which the work vehicle was designed. Very often this requires the vehicle operator to be familiar with and operate the vehicle controls necessary to both maneuver the work vehicle and operate the work tools or implements. At times, the operator may need to control vehicle heading and speed simultaneously with operation of the implements. Certain work vehicles, such as those with a number of implements or with implements having multiple degrees of freedom in movement, may be rather complex to operate and require the operator to have considerable related skill and experience. Suboptimal operation of the vehicle or the implements may have costly consequences, for example, in terms of inefficient or imprecise performance at the work site causing extra labor and equipment-related costs or waste of materials at the work site before or after the work is undertaken.

One particularly complex work vehicle is the motor grader, which is generally used in the construction industry to set grade. Modern motor graders are typically large machines with a long wheel base in the fore-aft direction of the vehicle. The large platform gives rise to additional maneuverability-enhancing features being added to the machine, separate and apart from conventional heading and speed control features. For example, motor graders may be outfitted with an articulated chassis in which the front section of the chassis having the steered wheels may pivot with respect to a rear section having the drive wheels, which has the effect of shortening the overall wheel base of the machine. Motor graders may also have the capability to tilt the steered wheels off of the rotational axis of the wheels, in other words to lean the wheels, and thus lean the machine and shift the vehicle's heading, toward either side of the machine. These features thus provide for an improved (i.e., shorter) turning radius, making the large machine nimbler than otherwise possible. Beyond the heading and speed control, motor graders may have a rather complex implement control scheme and one or more implements. The primary tool on motor graders is the moldboard or blade, which is mounted to a turntable known in the industry as a "circle". The circle is adjustably mounted to the vehicle frame, and the blade in turn is adjustably mounted to the circle, thus giving the blade a wide-range of possible movements. Specifically, the circle may be able to raise and lower with respect to the vehicle frame to adjust blade height, either uniformly from heel to toe, or independently to tilt the blade with respect to horizontal. The circle may also be able to shift to a lateral side of the vehicle by pivoting about the main frame so that the angular position of the blade about the vehicle's centerline may change, for example, to work embankments or raised ground to a slide of the machine. The circle may also rotate about a generally vertical axis with respect to the vehicle frame in order to change the angular position of the blade about the vertical axis such that the toe end of the blade may be positioned forward of the heel end of the blade in the fore-aft direction at either side of the vehicle frame. The blade may be mounted to shift laterally side-to-side with respect to the circle to move the blade further toward one side of the machine. The blade may also be capable of tilting in the fore-aft direction with respect to the circle to change its pitch. Various combinations of these operations may be undertaken.

To perform all of the aforementioned functions and operations, motor graders have in the past been outfitted with a relatively large number of mechanical control levers and knobs that may each control operation of a single, discrete operation or motion. In some modern motor graders, the manual mechanical controls have been replaced with electronic controls. Sometimes these controls are arranged in banks of primarily single axis joysticks, which the operator may manipulate forward and backward using his or her fingertips, and which each control a single, discrete function. The operator controls may also be a pair of multi-axis joysticks, which are used to assist control of the vehicle heading and to actuate the circle and blade assembly and other attached implements. A consequence of consolidating the number of controls that need to be manipulated by the operator is that a dual joystick control system requires that a significant number of operations need to be carried out by each joystick, and thus, each joystick must be manipulated along several axes and carry a large number of control inputs (e.g., switches). Apart from the sheer number of control inputs (e.g., switches and joystick movements), some of the operations may need to be performed in a particular sequence or simultaneously. This compounds the possible number of switch and joystick movements that may be required of the operator.

Given the complexity of the control scheme in such vehicles, even the process of converting the machine from a work posture to a transport posture may require a number of components to be changed to a transport state or orientation, possibly requiring the operator to execute numerous control commands, and possibly in a specific order.

The following discusses aspects of the disclosed control system that address these and other issues with respect readying large work vehicle platforms, such as motor graders, for transport. For example, the disclosed control system may be used to receive operator commands for movement of implements (e.g., in one or more of lowered/raised height positions, left/right lateral positions, front/back fore-aft positions, clockwise/counterclockwise rotated (or "steer angle") positions, and up/down slope (or "tilt angle") positions) in which case the control system determines a movement associated with the implement(s) based on the receipt of the operator commands.

A control system is disclosed that provides advanced control functionality to enhance the operator's ability in more efficiently transforming the work vehicle from a working posture or condition to a "roading" or transport posture or condition. For example, the control system provides advanced control functionality to stow multiple work implements using a single control input or single sequence of inputs to stow the implements simultaneously or consecutively. With a single movement or single sequence of movements of a finger, thumb or hand, for example, an operator may move multiple (e.g., all) of the work implements to a stowed orientation, thereby reducing the movements and switch actuations (and thereby the mental and physical strain) required of the operator to begin transport on-road. Aspects of this disclosure may also be carried out using a single voice command or single command string and a single motion gesture or single gesture sequence in systems having suitable voice and gesture recognition hardware and software.

In certain embodiments, the control system is configured to assess the posture of the work vehicle prior to stowing the implements. As used herein, the term "posture" refers to the physical orientation of the work vehicle, including the work implements, at a point in time. "Posture" may refer to the orientation of the work vehicle (and work implements) as a whole, or to one more components or subsystems of the work vehicle (and work implements). Moreover, the term is not necessarily limited to the heading or directional attributes of the work vehicle, nor to the any particular mode of operation (e.g., transport mode, work mode, auto-grade control mode, etc.). Rather, movement of one or more work implements relative to the work vehicle frame or chassis may change the work vehicle's posture. In assessing the posture of the work vehicle, the control system assists in the determination of whether attempting to stow the implements may be undesirable (e.g., when stowing an implement may cause it contact the work vehicle undesirably or create an obstruction). Damage to, or interference with the operation of, the work implements or other vehicle components may thus be reduced or avoided.

In other embodiments, the control system may assess the posture of the work vehicle and execute further steps upon determining that the current posture is unsuitable for stowage of one or more of the implements. The control system may, in addition to preventing stowing of all or only the implicated one or more work implements, issue an associated notification (e.g., alarm, display image/text, etc.) to the operator. Thus, the control system may inform the operator of the condition and prompt a manual adjustment of the machine and/or stowing of the implements.

Additionally or alternatively, the control system may, upon determining the current posture of the work vehicle is unsuitable for stowing implements, command various components of the work vehicle (or work implements) to re-orient, and thus cause the work vehicle to take a new posture. The control system may then reassess the spatial relationship of the work implements and the work vehicle at the new posture, and if acceptable, stow the implements. If still not suitable for stowing, the control system can command the work vehicle to take a further new posture, reassess and stow if acceptable. The control system may repeat this process until a posture is achieved in which stowing the work implements is acceptable. The control system may be configured to effect such automated re-posturing only within in certain limitations (e.g., re-posturing only to straighten the chassis or the steered wheels sufficient to create a clear path to stow one of the work implements).

In certain embodiments, the control system may be configured to effect stowing movement of the work implements according to certain hierarchical parameters or in certain patterns. As in all cases, the components controlled may be various machine control components (e.g., steering components, articulation components, etc.) and/or various components of the work implements. As one non-limiting example in a motor grader machine platform, the control system may first require the front and/or rear steered wheels to assume a straight-ahead, upright orientation prior to effecting rotation the blade (in the event that stowing the blade requires blade rotation).

The control system may also determine vehicle posture based on feedback input, including input signals from one or more sensors associated with the implements. A Global Positioning System (GPS) may be used to provide the sensor input of the three-dimensional geographical position of one or more of the implements. The sensor input (e.g., GPS, etc.) may be associated with stored positioning data, such as maps, geo-coordinate markers, and so on, to reconcile the real-time machine and implement position in three-dimensional space with known objects and grade locations of preset location or work site. Each implement may be individually controlled by the control system based an operator input, sensor input, stored data or combination thereof.

Further, the preceding does not address the numerous features and components of motor graders (or other work vehicles) that the operator may need to control other than the work implements. Such non-work implement components may include of various machine heading control components and actuators (e.g., engine, transmission and steering components) outside of the operator cabin as well as any of various features inside the operator cabin, including operator safety and comfort controls (e.g., heat and air conditioning, window clearing (wipers, defrost, etc.), seat swivel and height adjustments, audio (e.g., radio) controls, and so on) as well as any other feature or component that may be controlled by the operator of the work vehicle. Various lighting components (e.g., drive, work and hazard lights) may also be considered as part of the non-work implement features of the work vehicle. Any towing components and actuators may be considered as either work implement or non-work implement components.

In addition to changing the posture of the machine by stowing the implements, in certain embodiments the disclosed control system may also effect a change in state or mode of various components other than the implements. As mentioned various non-work implement components onboard the machine (e.g., hydraulic components, lights, transmission and drive components, and so on) may operate in different or on/off states or modes. One or more states or modes of these non-work implement components may have been determined to be beneficial for transporting the machine. Thus, in addition to stowing the implements, the same single operator input event may command one or more of the non-work implement components to enter a "transport state" or "transport mode," that is to either change to a transport state or mode from a work (or other non-transport) state or mode or to remain in a transport state or mode if already in such state or mode.

Furthermore, the reduced operator demand afforded by the disclosed system may be configurable or customizable. For example, the single activation event may be triggered by a single control input that is configurable by the operator to effect stowing and/or state or mode changing of a selected subset of all components available on the machine. These may or may not differ from the default or "factory" settings of the machine. As one example, the system may provide the operator with an interface display to access and configure embedded software by which one or more control inputs may be programmed to stow only a selected subset of the work implements on the machine (e.g., to simultaneously stow the main blade and scarifier of a motor grader, but not the ripper). As noted, similar selective control and customization of the state or mode of non-work implement components may be provided.

With reference to the drawings, one or more example implementations of the work vehicle control system will now be described. While a motor grader is illustrated and described herein as an example work vehicle, one skilled in the art will recognize that principles of the transport control arrangement disclosed herein may be readily adapted for use in other types of work vehicles, including, for example, various crawler dozer, loader, backhoe and skid steer machines used in the construction industry, as well as various other machines used in the agriculture and forestry industries. As such, the present disclosure should not be limited to applications associated with motor graders or to the particular example motor grader shown and described.

Figure 2:
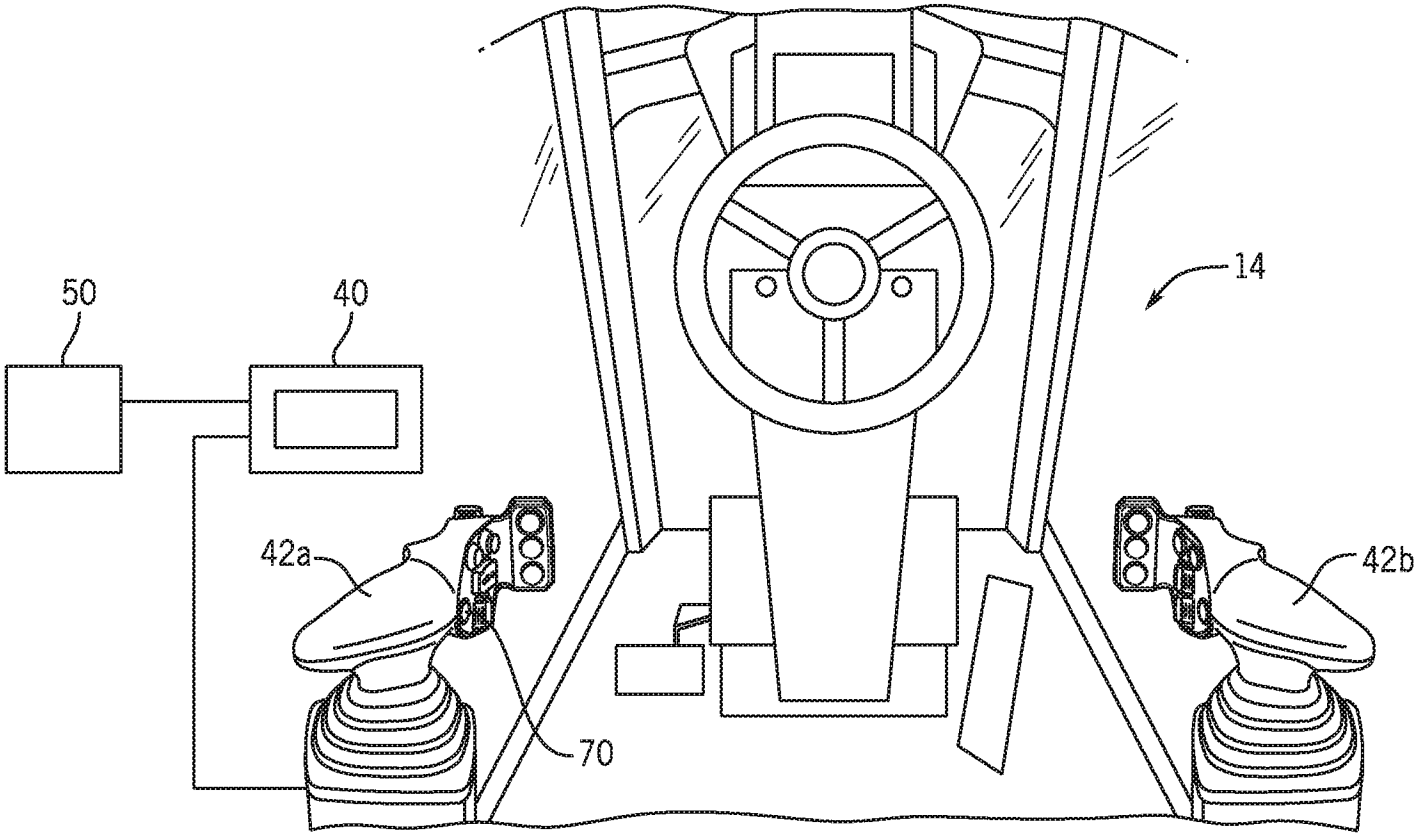
FIG. 2 is simplified view inside an operator cabin of the work vehicle of FIG. 1, showing example operator controls.

As shown in FIGS. 1 and 2, a work vehicle 10 in the form of a motor grader may include a chassis or main frame 12 supporting an operator cabin 14 and a power plant 16 (e.g., a diesel engine, an electric motor, etc.) operably coupled to power a drivetrain. The main frame 12 is supported off of the ground by ground-engaging steered wheels 18 at the front of the machine and by two pairs of tandem drive wheels 20 at the rear of the machine. The power plant 16 may power a hydraulic circuit described in more detail below. In the illustrated example, the main frame 12 has an articulation joint (not shown) between the operator cabin 14 and power plant 16 that allows the front section of the main frame 12 to deviate from the centerline of the rear section of the main frame 12, such as during a turning operation, to shorten the effective wheelbase, and thus the turning radius, of the work vehicle 10. The articulation joint may be pivoted by one or more associated hydraulic actuators (not shown).

A circle 22 and blade 30 assembly is mounted to the main frame 12 in front of the operator cabin 14 by a drawbar 32 and a lifter bracket 34, which in certain embodiments may be pivotal with respect to the main frame 12 or otherwise movable into different orientations. Blade shift actuators 24 may be mounted between the circle 22 and the blade 30 for extension of the blade 30 in either sideways direction. Blade lift actuators 26 may be mounted between the circle 22 and the lifter bracket 34 to raise, lower and tilt (side-to-side) the circle 22, and thereby the blade 30. A circle drive 28 may be mounted to the drawbar 32 to cause the circle 22 and the blade 30 to be rotated relative to a vertical axis (or otherwise upright axis relative to the main frame 12). Other implement attachments may be included in the work vehicle 10, including a scarifier 36 mounted to the front of the main frame 12 for deployment behind the steered wheels 18. Associated hydraulic components, including hydraulic actuators 38, may be included to raise and lower the scarifier 36.

The operator cabin 14 provides an enclosure for an operator seat and an operator console for mounting various control devices (e.g., steering wheel, accelerator and brake pedals), communication equipment and other instruments used in the operation of the work vehicle 10. Although not shown in the figures, it will be understood that various non-work implement components and features may be included onboard the work vehicle 10, both inside and outside of the operator cabin 12. Such features and components have been noted above, but include without limitation engine speed (e.g., cruise) control features, transmission control features, brake control features, front/rear steering control features, operator safety and comfort control features (e.g., HVAC, defrost, radio), and various lighting features inside and outside of the operator cabin 14.

The operator console may have a control interface including an operator control display 40, providing graphical (or other) input controls and feedback, and operator hand controls 42, including a left operator control ("LOC") 42*a* and a right operator control ("ROC") 42*b* are mounted in the operator cabin 14 at each side of the operator seat. In certain embodiments, the operator hand controls 42 may be joystick controls, such as multi-axis joysticks with numerous control inputs (e.g., buttons, rollers, switches, joystick movements, etc.) on each joystick for controlling numerous machine and implement functions, or they may be banks of multiple individual single- or dual-axis joysticks, where each joystick controls only one or two functions. Although, not illustrated, in addition to the operator hand controls 42, hardware and software for detecting voice commands and/or motion gestures may be incorporated into the system, as known in the art, to allow for hands-free or touch-free operation of the machine, including the transport control system.

The control display 40 and the hand controls 42 are operatively connected to one or more controllers, such as controller 50. The control display 40 and the hand controls 42 provide control inputs to the controller 50, which cooperates to control various electro-hydraulic valves to actuate the various drives and actuators of the hydraulic circuit. The controller 50 may provide operator feedback inputs to the control display 40 for various parameters of the machine, implement(s) or other sub-systems. Further, the control display 40 may act as an intermediary between the hand controls 42 and the controller 50 to set, or allow the operator to set or select, the mapping or functionality of one or more of controls (e.g., switches or joystick movements) of the hand controls 42.

The controller 50 (or others) may be configured as a computing device with associated processor devices and memory architectures, as a hard-wired computing circuit (or circuits), as a programmable circuit, as a hydraulic, electrical or electro-hydraulic controller, or otherwise. As such, the controller 50 may be configured to execute various computational and control functionality with respect to the work vehicle 10 (or other machinery). In some embodiments, the controller 50 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 50 (or a portion thereof) may be configured as an assembly of hydraulic components (e.g. valves, flow lines, pistons and cylinders, and so on), such that control of various devices (e.g., pumps or motors) may be effected with, and based upon, hydraulic, mechanical, or other signals and movements.

The controller 50 may be in electronic, hydraulic, mechanical, or other communication with various other systems or devices of the work vehicle 10 (or other machinery). For example, the controller 50 may be in electronic or hydraulic communication with various actuators, sensors, and other devices within (or outside of) the work vehicle 10, including various devices associated with the one or more pumps 52, control valves 54, and so on. The controller 50 may communicate with other systems or devices (including other controllers) in various known ways, including via a CAN bus (not shown) of the work vehicle 10, via wireless or hydraulic communication means, or otherwise. The controller 50 may be mounted in any suitable location onboard the work vehicle 10 or at various remote locations.

Various sensors may also be provided to observe various conditions associated with the implements (e.g., the blade 30) of the work vehicle 10. In some embodiments, various sensors may be disposed on or near the blade 30 or elsewhere on the work vehicle 10. For example, a GPS 60 may include one or more transceiver units mounted directly to the blade 30. Various other sensors, such as additional sensors 62 for the blade 30 and the scarifier 36, may also be disposed on or near the circle 22, the blade 30 and the scarifier 36. In some embodiments, the sensors 62 may include angle sensors to detect rotational angle orientations of the circle 22 and/or the blade 30, linear sensors to detect the "length" of an associated cylinder of the circle 22, the blade 30 and or the scarifier 36, or inertial measurement units (IMUs) or microelectromechanical sensors (MEMs) that observe a force of gravity and an acceleration associated with the circle 22, blade 30 and/or the scarifier 36. The various components noted above (or others) may be utilized to control movement of the blade 30 and the scarifier 36 via control of the movement of the one or more hydraulic actuators 24, 26, 28, 38. Accordingly, these components may be viewed as forming part of the operator control system for the work vehicle 10. Each of the sensors 62 may be in communication with the controller 50 via a suitable communication architecture.

In certain embodiments, the controller 50 outputs one or more control signals or control commands to the actuators 24, 26, 28, 38 associated with the blade 30 and the scarifier 36 based on one or more of the sensor signals received from the GPS 60 and the sensors 62 and/or inputs received from the operator via the hand controls 42. The controller 50 outputs the one or more control signals or control commands to the pumps 52 and/or control valves 54 associated with hydraulic actuators 24, 26, 28, 38 based on one or more of the sensor signals received from the GPS 60 and the sensors 62 and input received from the hand controls 42.

In certain embodiments, a control input on one of the hand controls 42 (e.g., LOC 42*a*) may be an auto-transport control 70. The auto-transport control input 70 may be a discrete or configurable control that provides input signals to the controller 50 to ready the vehicle for transport. For example, using the display 40 and touch screen control inputs thereon, an operator may perform a routine to configure the auto-transport control 70 to confirm or change the implements that are stowed using the auto-transport control 70. The operator may select from a list or otherwise input to the system which implements, from the set of available implements on the machine, will be auto-stowed or otherwise put in a transport mode or state. In the illustrated example, this includes the blade 30 and the scarifier 36, although various other implements (e.g., auxiliary blades and wings) may be selected or deselected and stowed by operation of the auto-transport control input 70, which will now be described in detail.

Figure 3:
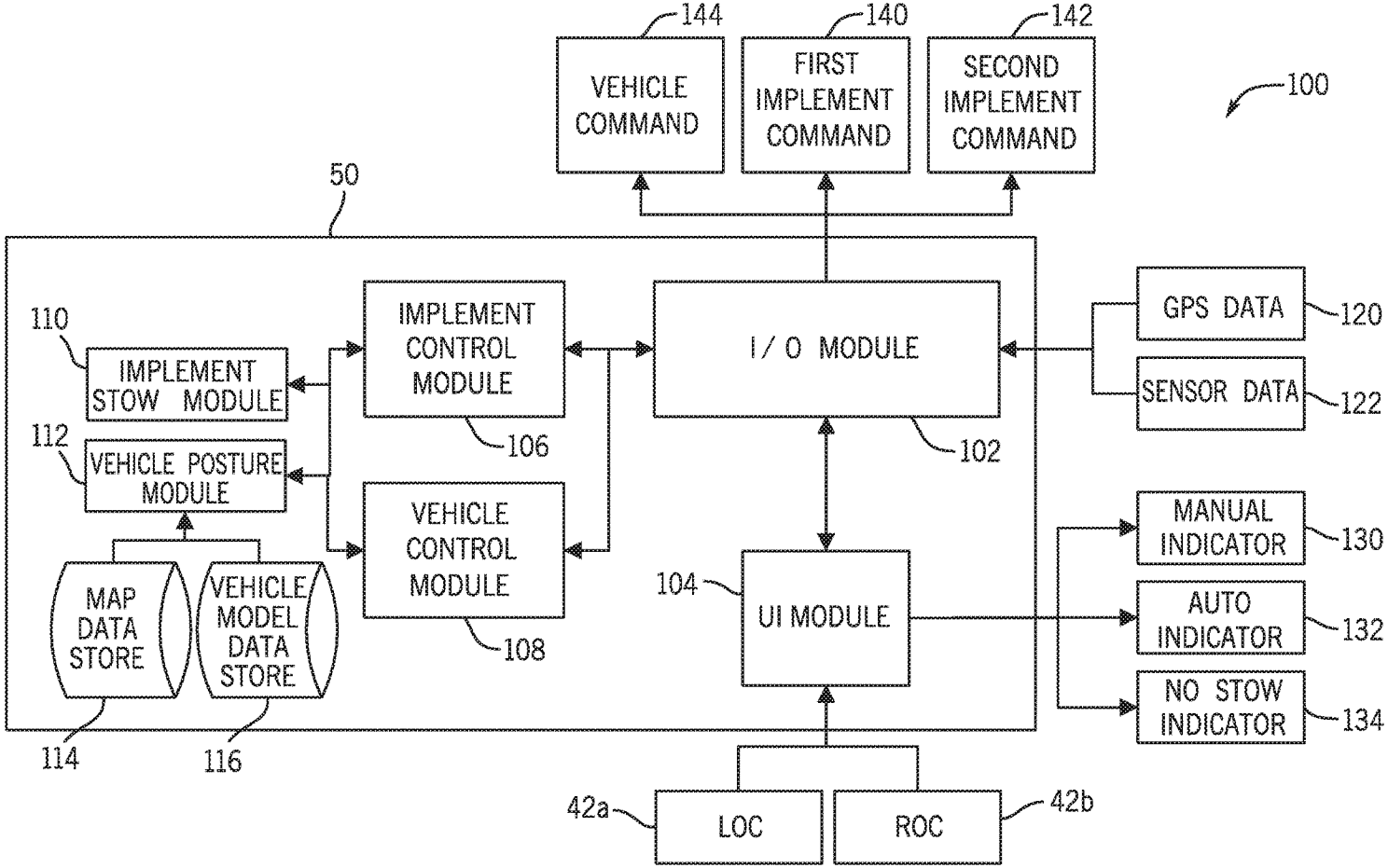
FIG. 3 is an example dataflow diagram for an example multi-implement stow control system according to this disclosure.

Referring also to FIG. 3, a simplified dataflow diagram illustrates an example control system 100 for the work vehicle 10 with control modules for stowing the work implements for transport, which may be embedded within the controller 50. Various embodiments of the control system 100 according to the present disclosure may include any number of other modules or sub-modules (e.g., an IGC module) embedded within the controller 50 that may be combined and/or further partitioned. Inputs to the control system 100 may be received from the GPS 60 and the sensors 62, operator interface (control display 40 and hand controls 42), and other control modules (not shown) associated with the work vehicle 10, and/or determined/modeled by other sub-modules (not shown) within the controller 50 (or other controllers). Various additional modules or sub-modules (not shown) for controlling the state and/or mode in which some or all of the non-work implement components operate may also be included. In various embodiments, the controller 50 includes an input/output (I/O) module 102, a user interface (UI) module 104, an implement control (IC) module 106, a vehicle control (VC) module 108, an implement stow (IS) module 110, a vehicle posture (VP) module 112, a map data store 114 and a vehicle model data store 116.

The I/O module 102 and the UI module 104 receive input data from one or more sources. The I/O module 102 may receive input data 120 in the form of coordinate signals from the GPS 60 and input data 122 in the form of feedback signals from one or more of the sensors 62 associated with the actuators 24, 26, 28, 38. The UI module 104 receives input data from the operator via the hand controls 42. The input data may include any of the control inputs (and others) mentioned above with regard to the example joystick operator controls, including the auto-transport control input 70. It will be understood that depending on the configuration of the control system 100, the auto-transport control input 70 may be a dedicated operator control input that is actuated once each time an implement auto-stow operation is desired by the operator. Alternatively, the stow control input may be a dedicated operator control input that an operator activates once to set the control system 100 in an auto-stow mode, which allows the control system 100 to automate stowing of the implements when prompted by other control inputs or to automatically stow the implements at previously determined states or postures of the work vehicle without further operator intervention. Additionally or alternatively, in certain configurations of the control system 100, the transport control input may be a single multi-tier input. Various examples of such a single multi-tier input may include a press and hold of a single control input, a multi-press of a single control input (e.g., double-click) that is either instantaneous or sustained, activation of multiple control inputs simultaneously or near-simultaneously (i.e., without delay attributed to separate consecutive control inputs), a specified sequence of multiple control inputs, a single voice command or motion gesture, and a single string or sequence of voice commands or motion gestures. It should be understood that the terms "single activation event" or "single operator input event" used herein include the aforementioned singular operator inputs, and should be distinguished from the mere consecutive execution of separate control inputs. Further, the control system 100 may be used by the operator to provide manual stow positioning in certain vehicle states or control modes. The term "manual" (and derivatives) are used herein to mean that the positional movements of the implements are being directed by the operator, for example, via the hand controls 42. Thus, various control schemes are possible to effect automated stowing of the work implements or other transport functionality. The auto-transport control input 70 and/or the control system 100 may be configured to send and receive a single input signal to initiate the auto-stow control or control mode. A single activation event of the auto-stow control input 70 may also cause a multi-part or packeted signal, or a set of multiple signals, to be sent as inputs to the controller, which in turn may be configured to send multiple command signals, including one or more for each implement.

In certain embodiments, the UI module 104 may also output one or more notifications to the control display 40 (e.g., in the form of audible, tactile and/or visual notifications) to notify the operator of the implement control mode, for example, including a manual mode indicator 130, an auto mode indicator 132 and a no stow indicator 134. The UI module 104 may output other data to the operator, including for example, geographical location coordinates or map data 114 with the current position of the work vehicle 10.

In the stowing context, the UI module 104 and the I/O module 102 receive and transmit the input data for a command to stow the implements to the IC module 106. In certain embodiments, as mentioned, the hand controls 42 and the control system 100 may be configured to permit the operator to supply a manual stow control input that the control logic will resolve in one or more commands to control one or more of the control valves to control hydraulic flow to the actuators associated with the implements. The IC module 106 then generates, and transmits via the I/O module 102, commands 140, 142 to move the implements, which includes a corresponding command signal (e.g., current, voltage, etc.) with the applicable control parameters (e.g., duration, amplitude, etc.). The I/O module 102, the UI module 104 and the IC module 106 receive and process the various inputs from the hand controls 42 to position the implements as commanded. As one example, the controller 50 may command the actuator 28 to rotate the circle 22 to reorient the steer angle of the blade 30, while receiving feedback from the associated sensor 62 to monitor and terminate rotation and simultaneously or consecutively command the respective actuators 26 and 38 to raise the blade 30 and the scarifier 36, while receiving feedback from the associated sensors 62 to monitor and terminate positioning when fully raised. Thus, as explained, the operator (or other) input may command manual positioning of the implements directly. The UI module 104 may output the manual mode indicator 130 momentarily or during the manual positioning of the implements.

In some embodiments, even during manual operation, the control system 100 may be configured such that the VP module 112 determines whether stowing of one or more of the implements is contra-indicated. Depending on the control logic, the controller 50 may proceed in various degrees of passivity, namely by effecting one or more of the following: (i) the UI module 104 may provide a warning to the operator (e.g., via the no stow indicator 134), (ii) the IC module 106 may override the UI module 104 and cease stowing movement of one or more of the work implements, or (iii) the IC module 106 and/or the VC module 108 may interrogate the IS module 110 and/or the VP module 112 and alter the work vehicle's posture (as described in detail below) before carrying out the implement stow commands.

In certain embodiments, the IC module 106 ascertains (e.g., by interrogating the UI module 104) whether there has been received an auto-stow input (again, either an auto-stow control input or an auto-stow mode input depending on the configuration of the control input and/or the control system). After an operator initiates an auto-stow command (or at the appropriate vehicle state when in auto-stow mode), the IS module 110 and the VP module 112 of the controller 50 are triggered. The VP module 112 first works to determine the posture of the work vehicle. Then, either the VP module 112 or the IS module 110 determines whether the posture is suitable for stowing of the implement or if posture alterations are necessary. After this, the IS module 110 determines, based on the posture modeling, what stowing procedures must be followed, if any.

In certain embodiments, the VP module 112 processes sensed data indicative of the actual orientation of the machine relative to stored model data indicative of the configuration of the machine, and possibly also of the expected environment in which the vehicle is operating. For example, the VP module 112 may analyze the sensor data 122 with respect to vehicle model specific information (e.g., machine build dimensions, the presence and dimensions of accessory and implement attachments, virtual replications or CAD drawings of the vehicle and implements, etc.) stored in the vehicle model data store 116 in order to ascertain an actual (or current) posture of the work vehicle. The VP module 112 may also consider the actual location of the work vehicle and its expected environment by analyzing the GPS data 120 relative to the map data (e.g., topographical maps or geographical coordinate information) stored in the map data store 114. It should be understood that the VP module 112 need not consider the vehicle's location or environment, and further that it may ascertain the overall posture of the motor grader or only a portion thereof pertinent to the movement of the implements to be stowed (e.g., a front, mid or rear section of the vehicle at which the implements being stowed are mounted).

In the illustrated example, the VP module 112 then analyzes the actual posture determination with respect to certain configurational and operational information in the vehicle model data store 116 to determine whether the implements may be stowed (e.g., whether the implements may be moved to the stowed orientations without contacting or otherwise interfering with another machine component, implement or the work environment). If not, the VP module prompts the IC module 106 and/or the VC module 108 to move one or more machine or implement components to alter the posture of the work vehicle to permit the implements to be stowed. That is, the IC module 106 and/or the VC module 108 resolves the necessary control values and generates the associated commands 140, 142, 144 for transmission, via the I/O module 102, to the movable components of the work vehicle and/or the implements, as needed. Iterative or continuous, real-time assessments of actual vehicle posture and stowability, and of subsequently posture modification, may be made by the VP module 112, as needed. The movements informed by the VP module 112 are generally, but not necessarily, movements that would not ordinarily be made in stowing any of the implements (i.e., movements of non-stowed components or movements of stowable components into non-stowed orientations).

Figure 5A:
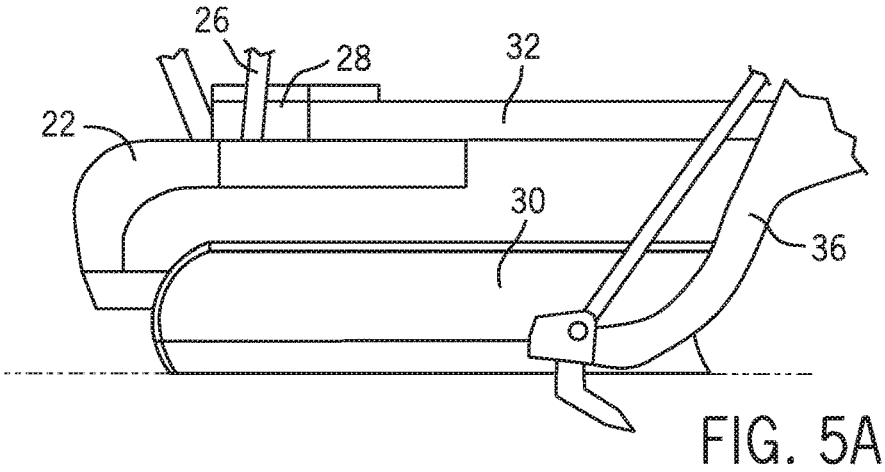
FIGS. 5A-5C are schematic views showing an example stowing operation of multiple work implements of the work vehicle of FIG. 1.
Figure 5B:
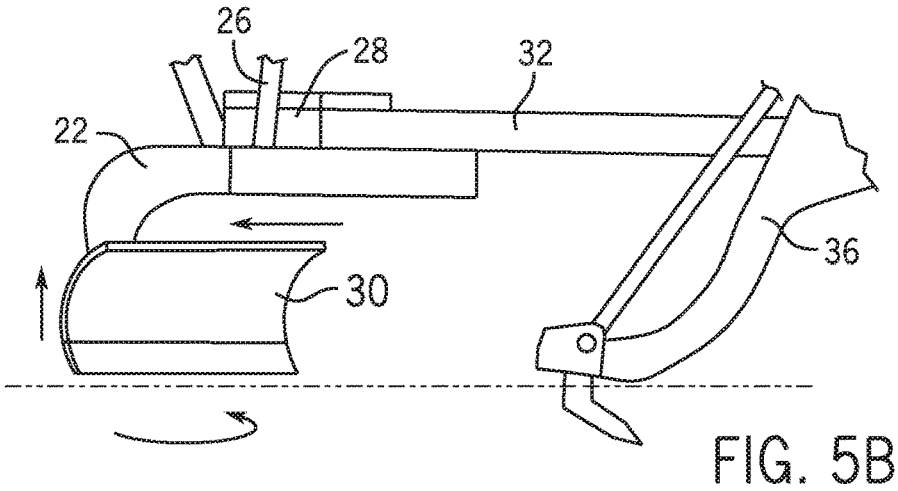
Figure 5C:
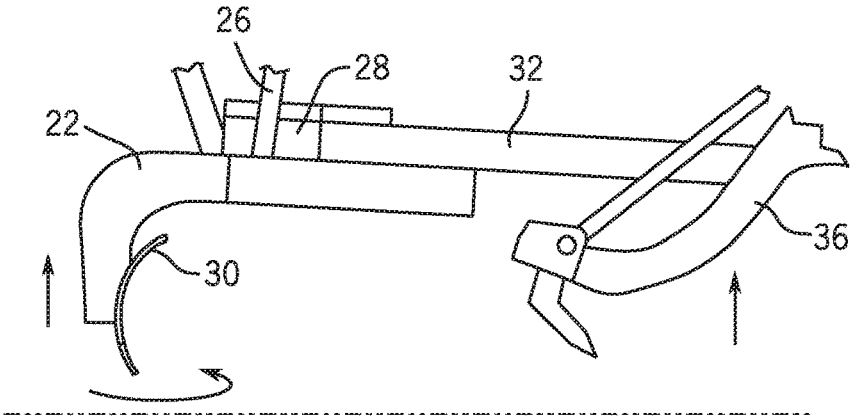

When the controller 50 determines that the work vehicle posture is suitable for stowing the implements, the IS module 110 then processes stored algorithms to determine a routine for stowing the implements. In some cases, this may be nothing more than the simultaneous retraction of the actuators controlling the height of the implements (e.g., simply raising the blade 30 and scarifier 36). In other cases, the routine may be a set stowing pattern for an individual implement (e.g., the blade may first be raised off the ground, shifted to center, rotated to center and then raised fully). In other cases, the routine may be a pattern that coordinates the movements of multiple implements (with or without intra-implement stow patterning). For example, as shown in FIG. 5A, the blade 30 may be shifted significantly to one side of the circle 22, which itself may be rotated significantly, such that it would interfere with raising of the scarifier 36, despite the work vehicle otherwise being a posture suitable for stowing the implements. As shown in FIGS. 5B-5C, the stowing routine resolved by the IS module 110 may be to first reposition the blade 30 (e.g., following the aforementioned raise, center shift/rotate and raise pattern) before allowing the scarifier 36 to be raised. Thus, the IS module 110 may follow a control scheme that enforces an operational hierarchy of coordinated movements of the various implements. In still other cases, the stowing routine may coordinate movements of one or more work implements (e.g., blade or scarifier) and one or more machine components (e.g., articulation joint or steered wheels (turn/lean)). While this would typically be unnecessary for reasons of unimpeded stowing following the action of the VP module 112, it may be desirable for further automating the transition of the work vehicle from one mode to another (e.g., from work mode to transport mode).

The IC module 106 resolves the necessary control values and generates the associated commands 140, 142 for transmission to the movable implement components via the I/O module 102. And should the stowing routine resolved by the IS module 110 call for movement of machine components in addition to the stowing of the implements, the VC module 108 may resolve the necessary control values and generate the associated commands 144 for transmission to the movable vehicle components via the I/O module 102.

Figure 4:
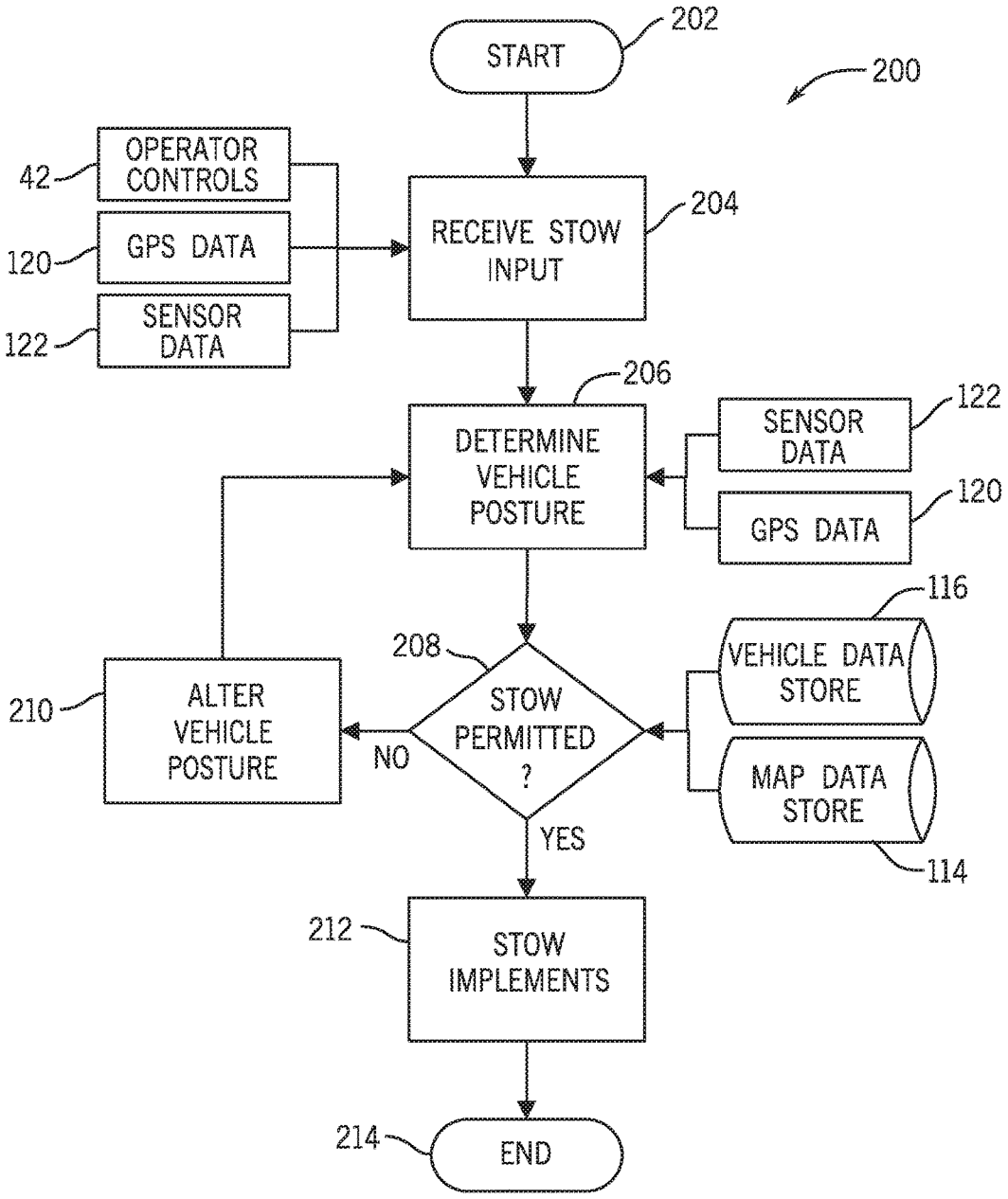
FIG. 4 is a flowchart for an example multi-implement stow control method.

Referring now also to FIG. 4, a flowchart illustrates a coordinated implement control method 200 that may be performed by the control system 100 of the present disclosure. As can be appreciated in light of the disclosure, the order of operation within the method 200 is not limited to the sequential execution as illustrated in FIG. 4, but may be performed in one or more varying orders as applicable and in accordance with the present disclosure. Moreover, the illustrated coordinated implement control method 200 may be executed separate from, or may incorporate, the control of one or more non-work implements into a transport mode or state along with the work implements, and particular as part of a combined, single event actuation of a control input. Thus, although non-implement components are not specifically addressed, it will be understood that the example coordinated implement control method shown and described does not exclude control of one or more non-work implement components, nor limit the scope of this disclosure in this regard.

In one example, the method begins at step 202. At step 204, the controller 50 receives the input data 120, 122 (and commands from hand controls 42) and determines whether the input data 120, 122 (and commands from hand controls 42) includes an input for stowing the implements, either a discrete auto-stow control input or an auto-stow mode input. When the controller 50 receives a stow input, the method proceeds to step 206 to determine the posture of the work vehicle 10, including the orientation of each implement to be stowed as well as any other implements carried by the vehicle that may impact the stowing of the desired implements, if less than all implements are to be stowed. The controller 50 may receive feedback or other position indicating signals in the sensor data 122 received from one or more of the sensors 62 and the GPS data 120 with reference to the coordinate or map data in the map data store 114. The controller 50 may evaluate the actual machine orientation and location information from the GPS data 120 and the sensor data 122 with respect to stored model data of the particular machine in the vehicle model data store 116 and the environment in which it is working from the information in the map data store 114. The controller 50 may use also timers or other devices or techniques for achieving the commanded position without feedback. The controller 50 will determine the vehicle posture overall or at least the region of the vehicle concerning the implements to be stowed. Based on this analysis, the controller 50 will determine whether the implements may be stowed at the determined posture of the vehicle, at step 208.

If the vehicle is not postured to allow one or more of the implements to be stowed, the method continues to step 210 to alter the posture of the vehicle, by generating the necessary commands (e.g., to the hydraulic pumps 52, control valves 54 and/or actuators 24, 26, 28, 38) to reposition various movable components of the work vehicle and/or the implements. The controller 50 may again determine the orientation of the implements relative to the machine frame, receiving feedback or other position indicating signals in the sensor data 122 received from one or more of the sensors 62 associated with the implements. Although not shown, it should be understood that the method 200 may loop to perform successive verification and re-posturing steps, as needed. It should be understood that the controller 50 may instead use timers or other devices or techniques for achieving the re-postured position without feedback. In any case, when the proper re-postured position has been achieved, the method may proceed to 212.

At step 212, the method continues such that the controller 50 resolves a stow routine for the implement being stowed and generates the necessary commands (e.g., to the hydraulic pumps 52, control valves 54 and/or actuators 24, 26, 28, 38) to stow the implements, including to execute specific stow routines for an individual implement or for multiple implements stowed in a coordinated manner with themselves or other movable components of the machine. The controller 50 may receive feedback or other position indicating signals in the sensor data 122 received from one or more of the sensors 62 associated with the blade 30. The controller 50 may use also timers or other devices or techniques for achieving the commanded position without feedback. When the implements have been stowed, the method may end at step 214.

The foregoing description details systems and methods for automating the stowing of multiple implements of the work vehicle to facilitate transport of the machine via roadways and the like. As noted above, in addition to changing to a transport posture of the machine by stowing the implements, in certain embodiments the disclosed control system may also effect a change from a work state or work mode to a transport state or transport mode of various components other than the implements. This may include, for example, controlling various machine posture control components to move to a transport state, including for example, straightening articulation, front and/or rear wheel steer and wheel lean components. The control system will control (e.g., actuator or disable) the one or more pumps 52 and control valves 54 of the hydraulic system as needed to move the machine posture components into transport states. This may also include changing various components of the drive train (e.g., initial gear setting, range gear selectors, creeper gear selectors, differential lock components, and so on) into predetermined transport settings. For example, a transport control input for the drive train may be to change the transmission from a six wheel drive mode to a two wheel drive mode and to set the "auto-shift" mode to "on." The states of various other non-work implement components onboard the machine, such as various lights and beacons (not shown), may also be changed. For example, drive lights and hazard lights may be turned "on" and work lights may be turned "off." The operational states of various other non-work vehicle implements (e.g., front/rear defrost, HVAC system, audio/video systems, engine cruise, hitch controls, and so on) may be changed.

Thus, as noted above, the aforementioned control system 100 and method 200 may incorporate or be modified to incorporate these additional aspects for automating vehicle transport such that the same single operator input event may command one or more of the non-work implement components to enter a transport state or transport mode. As will be understood, the non-work implement components (and actuation mechanisms therefor) are configured to communicate with the controller 50 (and also the display 50 as needed). Various sensors for determining the current state or mode of the non-work implement components are also configured to communicate with the controller 50. For example, in the illustrated embodiment, the VC module 108 may be programmed to query configurational and operational information in the vehicle model data store 116 and use sensor data 122 related to certain non-work implement components to determine whether the certain non-work implement components are in a transport state or mode already, or whether than need to be changed to a transport state or mode. If so, the VC module 108 may resolve the necessary control values and generate the associated commands 144 for transmission, via the I/O module 102, to the various non-work implement components of the work vehicle, as needed. Further, the automated control method 200 may include an additional step or process (or possibly incorporate into the stow implements step 212) changing the various non-work implement components that were in a work state or work mode to a transport state or transport mode.

Thus, various example embodiments of a control system have been described in which multiple implements may be stowed (or non-work implements changed to transport states or modes) in an automated fashion. A single button press or other single activation event may instruct the control system to commence an automated implement stowing operation (and transport state or mode change) or to enter an automated mode for automated stowing at a predetermined vehicle state, posture or otherwise and for automated activation of various other components into a transport state or mode. The control system may verify that the machine is in a proper posture for stowing the implements. The control system may further determine and execute suitable stowing routines, including multi-component coordinated movements, to properly stow the implements.

As will be appreciated by one skilled in the art, certain aspects of the disclosed subject matter can be embodied as a method, system (e.g., a work vehicle control system included in a work vehicle), or computer program product. Accordingly, certain embodiments can be implemented entirely as hardware, entirely as software (including firmware, resident software, micro-code, etc.) or as a combination of software and hardware (and other) aspects. Furthermore, certain embodiments can take the form of a computer program product on a computer-usable storage medium having computer-usable program code embodied in the medium.

Any suitable computer usable or computer readable medium can be utilized. The computer usable medium can be a computer readable signal medium or a computer readable storage medium. A computer-usable, or computer-readable, storage medium (including a storage device associated with a computing device or client electronic device) can be, for example, but is not limited to, an electronic, magnetic, optical, electromagnetic, infrared, or semiconductor system, apparatus, or device, or any suitable combination of the foregoing. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device. In the context of this document, a computer-usable, or computer-readable, storage medium can be any tangible medium that can contain, or store a program for use by or in connection with the instruction execution system, apparatus, or device.

A computer readable signal medium can include a propagated data signal with computer readable program code embodied therein, for example, in baseband or as part of a carrier wave. Such a propagated signal can take any of a variety of forms, including, but not limited to, electromagnetic, optical, or any suitable combination thereof. A computer readable signal medium can be non-transitory and can be any computer readable medium that is not a computer readable storage medium and that can communicate, propagate, or transport a program for use by or in connection with an instruction execution system, apparatus, or device.

Aspects of certain embodiments are described herein can be described with reference to flowchart illustrations and/or block diagrams of methods, apparatus (systems) and computer program products according to embodiments of the invention. It will be understood that each block of any such flowchart illustrations and/or block diagrams, and combinations of blocks in such flowchart illustrations and/or block diagrams, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions can also be stored in a computer-readable memory that can direct a computer or other programmable data processing apparatus to function in a particular manner, such that the instructions stored in the computer-readable memory produce an article of manufacture including instructions which implement the function/act specified in the flowchart and/or block diagram block or blocks.

The computer program instructions can also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Any flowchart and block diagrams in the figures, or similar discussion above, can illustrate the architecture, functionality, and operation of possible implementations of systems, methods and computer program products according to various embodiments of the present disclosure. In this regard, each block in the flowchart or block diagrams can represent a module, segment, or portion of code, which comprises one or more executable instructions for implementing the specified logical function(s). It should also be noted that, in some alternative implementations, the functions noted in the block (or otherwise described herein) can occur out of the order noted in the figures. For example, two blocks shown in succession (or two operations described in succession) can, in fact, be executed substantially concurrently, or the blocks (or operations) can sometimes be executed in the reverse order, depending upon the functionality involved. It will also be noted that each block of any block diagram and/or flowchart illustration, and combinations of blocks in any block diagrams and/or flowchart illustrations, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A control system for a work vehicle having a plurality of movable components including at least two work implements, the control system comprising:

at least one controller; and at least one operator control having one or more control inputs configured to send control signals to the controller;

wherein the controller is configured to output a plurality of control commands corresponding to one or more control signals from a single activation event of the one or more control inputs;

wherein the control commands are configured to effect movement of the work implements into stowed orientations; and wherein the controller is configured to receive input indicative of a current posture of the work vehicle and to determine whether the work implements may be stowed in the current posture of the work vehicle.

2. The control system of claim 1, wherein the single activation event is a single activation of a single one of the control inputs.

3. The control system of claim 1, wherein the movable components include one or more machine control components of the work vehicle; and wherein the controller receives the one or more control signals from the single control input and outputs the control commands to effect movement of at least an associated one of the machine control components.

4. The control system of claim 1, wherein the controller outputs control commands to effect movement of the at least one associated machine control component so that the work vehicle takes a second posture prior to the work implements being moved to the stowed orientations.

5. The control system of claim 1, further including one or more sensors configured to send sensor signals to the controller indicative of a current posture of the work vehicle; and wherein the controller receives and processes the one or more sensor signals to determine whether the work implements may be stowed in the current posture of the work vehicle.

6. The control system of claim 5, further including a user interface; and wherein, upon determining that at least one of the work implements is not to be stowed at the current posture of the work vehicle, the controller outputs one or more control commands configured to send an associated notification to the user interface.

7. The control system of claim 5, wherein, upon determining that at least one of the work implements is not to be stowed at the current posture of the work vehicle, the controller outputs one or more control commands configured to effect a second posture of the work vehicle; and wherein the controller receives and processes one or more sensor signals indicative of the second posture of the work vehicle to determine whether the work implements may be stowed in the second posture of the work vehicle.

8. The control system of claim 7, wherein the controller outputs a plurality of control commands to stow the work implements in the second posture of the work vehicle.

9. The control system of claim 1, wherein at least one of the one or more control inputs is configurable by an operator such that the single activation event of the one or more control inputs causes the controller to output a plurality of control commands configured to effect movement of a user-selected subset of the work implements into stowed orientations.

10. The control system of claim 1, wherein the work vehicle includes one or more non-work implement components configured to operate in different states including a work state and a transport state; and wherein the single activation event of the one or more control inputs causes the controller to output one or more control commands configured to cause the one or more non-work implement components to be in the transport state.

11. A control system for a work vehicle having a plurality of movable components including at least two work implements, the operator control system comprising:

at least one operator control having one or more control inputs; and at least one controller configured to receive input indicative of a current posture of the work vehicle and determine whether the work implements may be stowed in the current posture of the work vehicle;

wherein, having determining the work implements may be stowed in the current posture of the work vehicle, the controller is configured to output a plurality of control commands corresponding to one or more control signals from a single activation event of the one or more control inputs to effect movement of the work implements into stowed orientations.

12. The control system of claim 11, wherein the controller is configured, upon determining that at least one of the work implements may not be stowed in the current posture of the work vehicle, to output one or more control commands to effect a second posture of the work vehicle.

13. The control system of claim 11, further including one or more sensors configured to send sensor signals to the controller to indicate the current posture of the work vehicle; and wherein the controller receives and processes the one or more sensor signals to determine whether the work implements may be moved to the stowed orientations at the current posture of the work vehicle.

14. The control system of claim 13, wherein, upon determining that at least one of the implements may not be stowed in the current posture of the work vehicle, the controller outputs one or more control commands configured to effect a second posture of the work vehicle; and wherein the controller receives and processes one or more sensor signals indicative of the second posture of the work vehicle to determine whether the work implements may be stowed in the second posture of the work vehicle.

15. The control system of claim 14, wherein the controller outputs a plurality of control commands to stow the work implements in the second posture of the work vehicle.

16. A work vehicle, comprising:

a chassis supported by ground-engaging wheels or tracks;

a plurality of movable components mounted to the chassis, including multiple work implements and multiple non-work implements; and a control system, including:

at least one operator control having one or more control inputs;

at least one controller configured to output a plurality of control commands corresponding to one or more control signals from a single activation event of the one or more control inputs; and one or more sensors configured to send sensor signals to the controller indicative of a current posture of the work vehicle;

wherein the controller receives and processes the one or more sensor signals to determine whether the work implements may be stowed in the current posture of the work vehicle; and wherein the control commands are configured to effect movement of at least one of the work implements into a stowed orientation and to change a state of at least one of the non-work implements.

17. The work vehicle of claim 16, wherein, upon determining that at least one of the work implements may not be stowed in the current posture of the work vehicle, the controller outputs one or more control commands configured to effect a second posture of the work vehicle;

wherein the controller receives and processes one or more sensor signals indicative of the second posture of the work vehicle to determine whether the work implements may be stowed in the second posture of the work vehicle; and wherein the controller outputs a plurality of control commands to stow the work implements in the second posture of the work vehicle.

18. The work vehicle of claim 16, wherein the work vehicle is a motor grader; and wherein the work implements include a blade, a circle, a ripper, and a scarifier.

* * * * *